United States Patent [19]

Fujihara et al.

[11] Patent Number: 4,503,814

[45] Date of Patent: Mar. 12, 1985

[54] SYSTEM FOR PREVENTING CAVITATION IN WATER-COOLED INTERNAL COMBUSTION ENGINE

[75] Inventors: Hidefumi Fujihara, Ageo; Hiroshi Okazoe, Tokyo; Yoichi Hashimoto, Ageo, all of Japan

[73] Assignee: Nissan Diesel Motor Company, Limited, Japan

[21] Appl. No.: 563,970

[22] Filed: Dec. 21, 1983

[30] Foreign Application Priority Data

May 12, 1983 [JP] Japan ..... 58/69784[U]
May 12, 1983 [JP] Japan ..... 58/69785[U]
May 12, 1983 [JP] Japan ..... 58/69786[U]

[51] Int. Cl.[3] ..... F01P 5/10
[52] U.S. Cl. ..... 123/41.3
[58] Field of Search ..... 123/41.3, 41.44–41.47, 123/41.01; 261/76

[56] References Cited

U.S. PATENT DOCUMENTS 1,359,389 11/1920 Krause ..... 123/41.3
1,623,804 4/1927 Muir ..... 123/41.3

FOREIGN PATENT DOCUMENTS 845899 9/1939 France ..... 123/41.3
57-93619 6/1982 Japan .
58-33729 3/1983 Japan .

*Primary Examiner*—William A. Cuchlinski, Jr.
*Attorney, Agent, or Firm*—Lowe, King, Price & Becker

[57] ABSTRACT

The cavitation prevention system according to the present invention is provided with an air introducing passageway for introducing an air within means for storing air, such as a water tank, into a cooling water passageway at a suction portion of a water pump. The means for storing air is provided with an air metering means for controlling an amount of air to be supplied to the cooling water circulating passageway, thereby to maintain an air mixture ratio at the desirable valve for effectively preventing cavitation erosion. An air flow control valve means mounted to the air introducing passageway is controlled by output signals from means for detecting various conditions of an engine in which cavitation occurs or cavitation teuds to occur accurately, wherein the air is introduced into the cooling water only when the engine condition requires it to prevent cavitation, but at other conditions of the engine the air introduction is not effected so as to improve the engine cooling performance.

16 Claims, 19 Drawing Figures

SYSTEM FOR PREVENTING CAVITATION IN WATER-COOLED INTERNAL COMBUSTION ENGINE

DESCRIPTION OF THE INVENTION

1. Field of the Invention

The present invention relates to a system for preventing cavitation erosion occuring on an inner surface of the water jacket in the water-cooled internal combustion engine such as Diesel engine.

2. Background of the Invention

In the water-cooled internal combustion engine, the cooling water passing through the water jacket absorbs the heat from high temperature parts such as the combustion chamber, the exhaust valve etc., and transfers the heat to the radiator in which, at the core thereof, the heat is subjected to heat exchange with wind caused by running of a vehicle or blast air from the engine-driven fan, and then the heat is discharged to the exterior. Thus the aforementioned high temperature parts are cooled to be kept at predetermined temperature and thereby to be prevented from thermal damages.

In such water-cooled engine, particularly the engine having the cylinder provided with liner confronting the water jacket well known as the wet liner cylinder, a cavitation phenomenon often occurs in the cooling water around the water jacket wall especially the cylinder liner due to vibrations of the cylinder liner or the cylinder block during operation of the engine.

This cavitation phenomenon is caused by numerous air bubbles produced in the cooling water is in contact with the circumferential surface of the water jacket wall or the cylinder liner. Generation of air bubbles is attributed to lowering of the water pressure following the impact contact between the piston and the cylinder liner and engine vibrations, and air bubbles are generated in the lower pressure section around microscopic recesses which are present on the water jacket wall or the cylinder liner surface in a great number. These bubbles are broken instantly when the lower pressure section shifts to a higher temperature. At this point, high frequency water pressure fluctuations are caused in the water jacket to produce cavitation erosion in the recesses of the water jacket wall or the liner surface, which, in turn, reduces the engine durability.

To prevent such cavitation erosion, the well known effective means is either controlling the dynamic displacement of the liner caused by viblations or lowering the surface tension of the cooling water by adding emulsion oil thereto.

One of the most effective method to prevent cavitation erosion is to mix air bubbles with the cooling water actively and utilize the compressibility of air bubbles to moderate pressure fluctuations in the cooling water. The apparatus for preventing cavitation erosion utilizing this method is proposed in Japanese Utility Model Application Disclosure Gazette No. 58-33729 and Japanese Patent Application Disclosure Gazette No. 57-93619. However, with the former method, an air introducing passageway is always in communication with the inlet side of a water pump of a water cooling water circulation passageway, and the air is supplied to the cooling water even when the cooling water is at a high temperature at which the cavitation is not likely to occur. Thus, this method has a fear for lowering the cooling effect of the cooling water. With the latter method, on the other hand, an air introducing passageway is provided for communicating the upper tank of the radiator with the cooling water passageway at the outlet side of the radiator, and a flow control valve is arranged in the air introducing passageway so as to control an amount of air to be introduced into the cooling water by controlling the flow control valve.

In that case, an amount of air to be mixed with the cooling water necessary to prevent the cavitation, with respect to an amount of the cooling water filling the cooling water passageway of the engine, is, for example, preferably a minimum 1.0 volume% and a maximum 15%. If the amount of air to be mixed exceeds this range, the cooling efficiency of the engine, the radiation efficiency of the radiator or the car heater efficiency are reduced. If the amount of air is too small, it is difficult to restrain occurrence of cavitation, the problem to which the present invention is directed. However, the above-mentioned latter method does not have any means for controlling the amount of air to be mixed with the cooling water and this method cannot keep the amount of air in a predetermined range. In other words, an amount of air to be mixed with the circulating cooling water is the amount of air present in the space between the cooling water level in the upper tank of the radiator before starting the operation of the engine and the cooling water level which has been raised as a result of air supply during the operation of the engine. However, since there is no means to regulate the cooling water level before starting the engine, this cooling water level after it has been raised as the result of air supply is the height of the inlet of the air introducing passageway provided in the upper tank. Consequently, neither an amount of cooling water nor an amount of air to be introduced into the cooling water circulating passageway can be specified. Thus a ratio of air to be mixed with the cooling water cannot be stabilized at a predetermined value.

Also, it is known that occurrence of cavitation largely depends on the condition of the engine.

Therefore, it is desirable to know the exact performance of the engine which tends to produce cavitation and to supply the necessary amount of air to the cooling water at the time when cavitation is likely to be generated. Supplying the air to the cooling water in the region where such supply of water is not required will deteriorate the engine cooling effect. Conventional means for detecting the state of the engine which tends to produce cavitation is disclosed in the above-mentioned Japanese Utility Model Application Disclosure Gazette No. 58-33729. It is to attach a piezoelectric element to the engine body and to know actual occurrence of cavitation from pressure vibrations by means of the piezoelectric element, then an amount of air to be supplied is controlled according to the detection signal. However, with this method, the piezoelectric element detects not only pressure fluctuations caused by occurrence of cavitation but also vibrations of the engine itself, and the cavitation detection precision is not high and unreliable. In this respect it is desirable to develop means for detecting the state of engine accurately.

Further, in introducing the air into the cooling water, a differential pressure between the pressure in the cooling water passageway into which the air is introduced and the atmosphere must be great enough, otherwise means for supplying air forcibly such as an air pump will be inconveniently required. Therefore, an appropriate means for introducing the necessary amount of air into the cooling water without said means for forcible supply of the air has been ardently waited for.

SUMMARY OF THE INVENTION

The cavitation prevention system according to the present invention is provided with means for storing air, such as a water tank having a space at the upper portion for storing air, said air storing means is arranged above the cooling water circulating passageway and communicating therewith, and air metering means for controlling an amount of air to be supplied to the cooling water circulating passageway, thereby to maintain an air mixture ratio at the optimal value, effectively prevent cavitation erosion and improve reliability of the engine without reduction of the engine cooling performance.

Further, the cavitation prevention system according to the present invention has an air flow control valve means in an air introducing passageway for supplying air into the cooling water circulating passageway, and means for detecting various conditions of the engine in which cavitation occurs or cavitation tends to occur accurately, wherein the air flow control valve is operated by output signals of the detecting means and the air is introduced into the cooling water only when the engine condition requires it to prevent cavitation, but at other conditions of the engine the air introduction is not effected so as to improve the engine cooling performance which results in providing a highly reliable cavitation erosion preventing function.

Furthermore, the cavitation prevention system according to this invention has an outlet for the air introducing passageway, said outlet is in projected form at the position where the air can be most easily sucked into the cooling water circulating passageway so that an amount of air to be introduced easily and with high precision.

The arrangment comprising the features of this invention is a cavitation prevention system of the water-cooled internal combustion engine for restraining cavitation erosion on the water jacket wall of the engine, the system including a cooling water circulating passageway for circulating the cooling water between the water jacket of the engine to which the cylinder liner is opposed and the radiator to transport the heat generated by the engine to the radiator by means of the cooling water to radiate the heat therein; a water pump mounted in the cooling water circulating passageway and which makes pressure supply of the cooling water forcibly; means for storing air having an inlet passageway and an outlet passageway which are communicating with the cooling water circulating passageway, said air storing means being disposed above the cooling water circulating passageway and having at its upper portion a space for storing air to be introduced into the cooling water in the cooling water circulating passageway; an air metering means for regulating an amount of air to be supplied to the cooling water circulating passageway and which is arranged in the air storing means; an air introducing passageway communicating the air storing space of the air storing means with the air sucking side of the water pump to lead the air from the air storing means into the cooling water to be mixed therewith by means of a suction pressure of the pump; an air flow control valve means mounted in the air introducing passageway; means for detecting the engine condition which is likely to produce cavitation erosion on the cylinder liner surface; and a valve control means adapted to operate the air flow control valve means by an output of the detecting means to provide a high air flow at the engine condition which is likely to produce cavitation erosion.

The construction and features of the cavitation prevention system according to this invention will be apparent from the following description of preferable embodiments as will be made in detail in reference with the accompanying drawing.

DETAILED DESCRIPTION OF THE INVENTION

Figure 1:
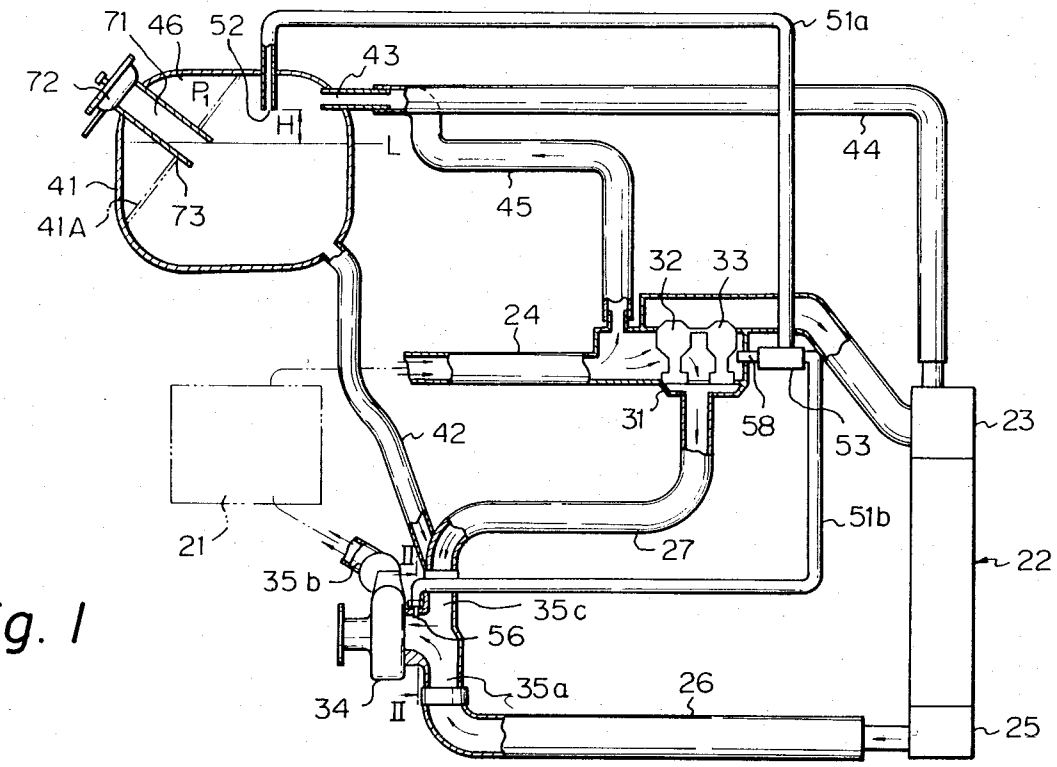
FIG. 1 is a schematic diagram of the cylinder liner cavitation prevention system with a partial section.

In FIG. 1, an engine 21 is a water-cooled Diesel engine having a wet type cylinder liner (not shown) defining a part of a wall of a water jacket of the engine body. The water jacket is formed in a cylinder head and a cylinder block, both constructing the engine body. A cooling water circulating passageway include an upper passage 24 which communicates the upper part of the water jacket in the cylinder head with an upper tank 23 of a radiator 22, a lower passage 26 which communicates the lower part of the water jacket in the cylinder block with a lower tank 25 of the radiator 22, and a bypass 27 which communicates the upper passage 24 and the lower passage 26.

The upper passage 24 is connected to the bypass 27 by way of a thermostat housing 31, and the thermostat housing 31 houses two thermostats 32, 33. Thermostats 32, 33 constitute together a temperature sensing valve means adapted to tend to close the bypass 27 and to open the upper passage 24 when a cooling water temperature is raised above a predetermined closure temperature, for example 76° C., and to fully close the bypass 27 and to fully open the upper passage 24 when the temperature is raised above 82° C.

Figure 2:
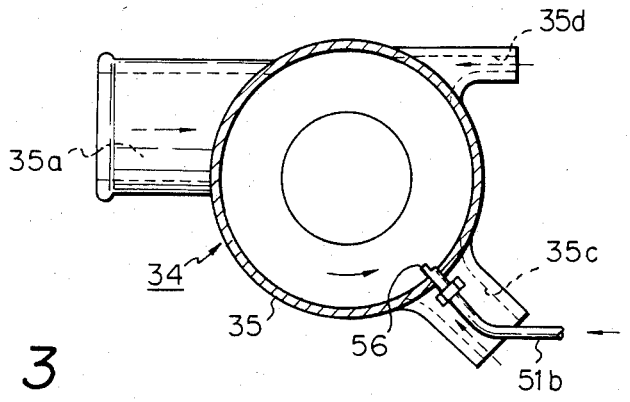
FIG. 2 is a sectional view along the line II—II of the water pump of FIG. 1.

To the lower passage 26, a water pump 34 is mounted for circulating the cooling water forcibly and which is rotated and driven by the crankshaft (not shown) of the engine. A water pump housing 35, as shown in FIGS. 1 and 2, has an inlet **35*a* and an outlet 35*b* of the main arranged in the lower passage 26, a bypass inlet 35*c* to which the downstream end of the bypass 27 is connected, and an inlet 35*d* for replenishing the cooling water to which the downstream end of an outlet passageway 42 of the cooling water communicating with a water tank 41**, details of which will be described hereinafter, is connected.

Therefore, when the engine 21 is operated in the cold state, thermostats which have sensed the cooling water at a low temperature will open the bypass 27 and close the upper passage 24, and under the operation of the water pump 34 the cooling water in the water jacket of the engine will be circulated through the upper passage 24, the thermostats 32, 33, the bypass 27, the water pump 34 and the water jacket without through the radiator 22. The circulated cooling water absorbs the combusion heat of the engine and gradually increases its temperature.

When the temperature of the engine cooling water reaches above the predetermined temperature of about 76° C., the thermostats 32, 33 sense the temperature and start to close the bypass 27 and start to open the upper passage 24. Then, a part of the engine cooling water passes through the radiator 22 to be radiated there. When the temperature of the cooling water reaches about 82° C. the bypass 27 is fully closed by the thermostats 32, 33 so that the temperature of the cooling water is lowered. Thus the cooling water is kept within the predetermined temperature range, and effectively cools the combustion chamber and the exhaust valve in the engine to prevent them from thermal damages.

The water tank 41 is disposed above the cooling water circulating passageway, namely, above the upper passage 24 or the upper tank 23 of the radiator. A port 43 at the upper part of the water tank 41 is communicated with the upper tank 23 and the thermostat housing 31 at the upperstream of thermostats 32, 33 by way of inlet passageways 44, 45. The air mixed in the cooling water floats on the cooling water in the upper tank 23 and introduced into the water tank 41 through the inlet passageway 44. The cooling water in the thermostat housing 31 at the upper stream of the thermostats 32, 33 is introduced into the water tank 41 through the inlet passageway 45 by means of discharge pressure of the water pump 34. The cooling water containing therein introduced air bubbles is separated into air and liquid by specific gravity difference in the water tank 41. An air storing space 46 is formed above the cooling water level L.

The outlet passageway 42 opened at the bottom wall of the water tank 41 is in communication with the cooling water replenish inlet **35*d* of the water pump housing 35, so that the cooling water accumulated in the tank is sucked into the cooling water inlet 35*d* of the water pump 34. An amount of sucked cooling water corresponds to the amount of cooling water introduced into the water tank 41 by way of the inlet passageway 45 and the amount of cooling water consumed in the cooling water circulating passageway by evaporation or leakage. The water tank 41, the outlet passageway 42, and the inlet passageway 44** form together air storing means of the present invention.

An inlet end 52 of an air introducing passageway **51*a* passes through the upper wall of the water tank 41 and extends downwardly into the air storing space 46. The other end of the air introducing passageway 51*a* is connected to an inlet 54 of a control valve 53 shown in FIG. 3 which serves as air flow control valve means. On end of an air introducing passageway 51*b* is connected to an outlet 55 of the control valve 53 and an outlet end 56 is connected to the water pump 34. The outlet end 56 is, as shown in FIG. 2, so attached by a connector 57 as to pass through the housing wall, and opens at a position adjacent the bypass inlet 35*c* of the pump housing 35 and extends inwardly in the housing at a predetermined distance D from the housing inner wall so as to effect the high suction negative pressure for sucking the air to be mixed with the cooling water. The shape of the forward end of outlet end 56 is such that the downstream side wall in a cooling water flow direction W is notched so that the outlet end 56 opens towards the downstream, as shown in FIG. 4**.

Figure 4:
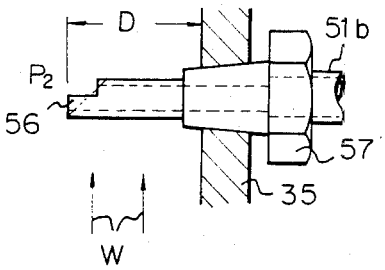
FIG. 4 is a view showing, in an enlarged scale, essential part in connection of the air introducing passageway to the water pump in FIG. 1.

As shown in line and dots in FIG. 4, the outlet end 56 may be formed by notching obliquely. By forming the outlet end 56 as such, a high suction negative pressure P2 is generated by the flow of the cooling water at the forward end of the outlet end 56 to provide a high differential pressure with respect to the pressure P1 in the air storing space 46 of the water tank 41 so that the air in the air storing space 46 can be effectively taken into the cooling water by way of the air introducing passageways **51*a*, 51*b***.

The water tank 41 has a port 71 for pouring the cooling water, and the port 71 is sealed by a filler cap 72 to provide air bleed freely by the differential pressure between inner and outer pressures. The port 71 is formed by a pipe 73 which extends into the tank, and the opening of the pipe 73 in the water tank 41 is set at the middle of the height of the tank. This provides a height difference H of between the open end of the pipe 73 and the open end of the air introducing psaageway passageway **51*a* so as to have a volume in the tank between the open ends sufficient to maintain the amount of the air to be mixed with the cooling water for requesting to prevent cavitation. In this manner, the water tank 41** is provided with means for metering an amount of air to be mixed.

Figure 3:
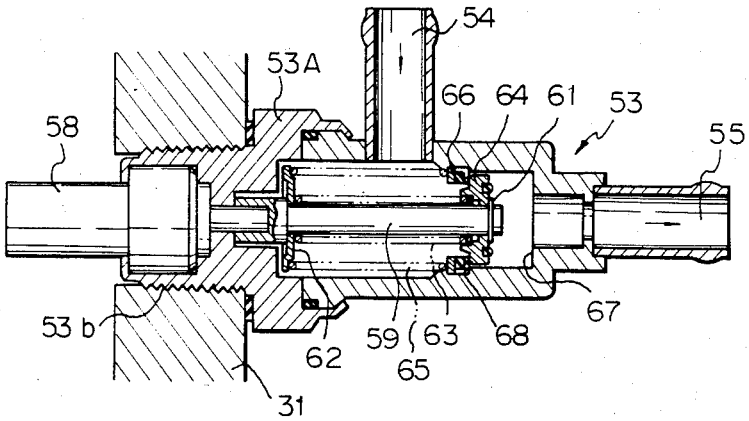
FIG. 3 is a vertical sectional view of the air flow control valve of FIG. 1.

The control valve 53 includes a valve body in a valve housing 53A shown in FIG. 3, to one end of which a temperature sensing portion 58 is attached. In other words, the temperature sensing portion 58 consisting of a case which is filled with thermowax material adapted to make thermal expansion and contraction in response to the temperature is secured to the forward end of the valve housing 53A. The valve housing 53A has a screw portion **53*b* therearound, which is threaded into the thermostat housing 31 so that the temperature sensing portion 58 is subjected to the cooling water in the thermostat housing 31. The thermowax material is volume-variable as it is guided by the case, and one end of a rod 59 is substantially connected to an output end volume-variation of the thermowax material. To the other end of the rod 59, a snap ring 61 is secured. A first valve body 64 is in pressure contact and locked to the snap ring 61, said first valve body 64 receiving the effect of spring force of a first spring 63 supported by a spring retainer 62 locked to the other end of the rod 59. A second valve body 66 is in pressure contact with the first valve body 64 under a force of a second spring 65 which is also supported by the spring retainer 62. Both first and second valve bodies 64, 66 have a sealing rubber rings. The valve housing 53A has a first valve seat 67 and a second valve seat 68 between the inlet 54 and the outlet 55. The first valve body 64 has a clearance from the inner circumferential surface of the valve housing 53A, but the second valve body 66** slides against the inner circumferential surface with sealability.

With such air flow control valve means, the thermowax material in the temperature sensing portion 58 makes volume expansion in response to increase of the temperature of the cooling water to lift the rod 59 to the right on the drawings. As a result of this, when the cooling water is at a certain temperature T1, for example, within the rage of 0 C. and 10 C. of the engine's extreme low temperature, the communication between the inlet 54 and the outlet 55, that is, the communication between the air introducing passageways **51*a* and 51*b* is closed by the pressure contact between the first valve body 64 and the second valve body 66 and the contact between the second valve body 66 and the housing 53A**.

When the cooling water is at a temperature between T1 and T2, for example about 74° C., the thermowax material makes further expansion so that the second valve body 66 makes pressure contact with the second valve seat 68 to be separated from the first valve body 64, and only the first valve body 64 moves to the right. In this state, the communication between the inlet 54 and the outlet 55 is resumed.

When the cooling water temperature is raised above T2, the first valve body 64 is further lifted to be in pressure contact with the first valve seat 67, and again the communication between the inlet 54 and the outlet 55 is closed. The control valve 53 which forms such air flow control valve means is so arranged that the valve closing temperature 74° C. for closing the communication between the air introducing passageways **51*a*, 51*b* is set at a lower temperature than the valve closing temperature Tt, 76° C. of the bypass 27 of thermostats 32,33. With the present example, the thermowax material filled temperature sensing portion 58 serves as means for detecting the engine condition, and the rod 59 serves as valve control means for controlling valves 64, 66 as a rigid means for transmitting the engine combustion variations to valves 64, 66. Further, the thermowax material and the rod 59** form temperature sensing driving means.

Now the operation of the above described embodiment will be explained.

When the cooling water is at a temperature lower than the temperature of for example 76 C. at the initial start of the engine in cold condition, the thermostats 32, 33 sense this temperature and the bypass 27 is opened. Thus, the cooling water which has absorbed the heat in the water jacket of the engine will not flow into the radiator 22, but supplied into the water pump 34 through the bypass 27, and it will be again directed to the water jacket under pressure to warming up.

Figure 5:
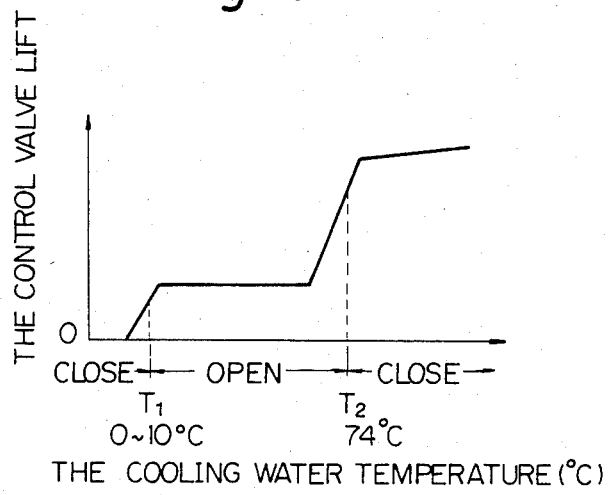
FIG. 5 is a diagram showing the performance characteristics of the air flow control valve in FIG. 3.
Figure 6:
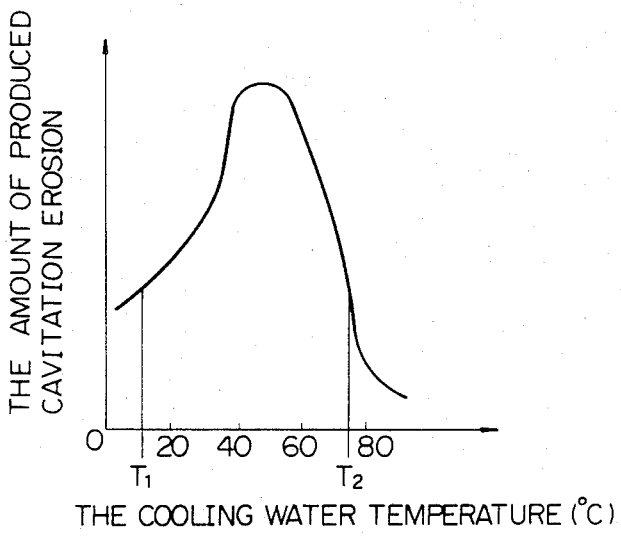
FIG. 6 is a diagram showing the correlation between cooling water temperature and cavitation erosion.

Such low temperature engine driving condition is in general inclined to produce cavitation erosion on the cylinder liner surface, as shown in FIG. 6. At this time, volume changes of the thermowax in the temperature sensing portion 58 of the control valve 53 which has sensed the temperature of the cooling water in the thermostat housing 31 provide the temperature range of T1–T2 of the cooling water which is most liable to produce cavitation erosion. As described above, the second valve body 66 makes pressure contact with the second valve seat 68, and the first and second valves are separated from each other so that the air introducing passageways **51*a*, 51*b* are communicated, as shown in FIG. 5. Then, the air in the air storing space 46 in the water tank 41 is supplied into the cooling water in the form of air bubbles under the differential pressure between the pressure P1 of the air storing space 46 and the pressure P2 adjacent the outlet end 56 of the air introducing passageway 51*b***, and the air bubbles are introduced into the cooling water. During the engine driving the cooling water in the water jacket has water pressure fluctuations by impact between the cylinder liner and the piston, pressure fluctuations are moderated base on flexible deformation of the volume of the introduced air bubbles. Thus, pressure fluctuations around the water jacket wall especially cylinder liner are reduced so as to effectively restrain production of cavitation, and as a result of this, occurrence of cavitation erosion on the wall is prevented and durability of the engine is improved.

When the temperature of the cooling water is raised with the continuous driving of the engine at a temperature above T2, for example 74° C., the ratio for producting cavitation in the water jacket of the engine drastically lowered. At this time the thermowax material of the temperature sensing portion 58 of the control valve 53 senses the cooling water temperature and expands further. Then, as described above, the first valve body 64 is lifted to the right on the drawings to be seated in the first valve seat 67 thereby to close the communication between the air introducing passageways **51*a*, 51*b***. Thereafter, air supply to the cooling water in the high temperature range where cavitation is difficult occur is firmly stopped, and the thermal capacity of the cooling water is increased to firmly maintain the engine cooling effect as in the conventional manner, so as to prevent engine damages by thermal load, which, in turn, improves reliability of the engine.

When the temperature of the cooling water is raised above the valve closing temperature Tt for example about 76° C. of the thermostat, thermostats 32, 33 sense this temperature and start to close the bypass 27 and start to open the upper passage 24. Thus, the cooling water which has been sent to the upper passage 24 from the engine 21 will be sent to radiator 22 where the heat is radiated, and the cooled water will be sucked into the water pump 34 by way of the lower passage 26, and will be returned again to the engine 21. Here, the temperature of the cooling water is lowered. When the cooling water temperature is lowered to the valve closing temperature Tt of thermostats 32, 33, thermostats 32, 33 open the valve to shift the cooling water flow direction to the bypass 27 to lower the heat radiation to increase the temperature of the cooling water again. By repeating this operation, the temperature of the cooling water can be kept in almost a constant temperature range.

In the present example, the thermowax material of the temperature sensing portion 58 of the control valve 53 makes contraction when the cooling water temperature is below T1 of the extreme low temperature, and because of this the first and second valves 64, 66 are in pressure contact to be in a minimum lifting position, namely, at the left end, to close the mutual communication of the air introduction passageways 51*a*, 51*b*. Therefore, except the very initial stage of engine cooling period, which is negligible in terms of production of cavitation, wherein the air is not introduced into the cooling water, the air introduction to prevent cavitation is made substantially in all areas of the low temperature range. Additionally, if wax leakage occurs at the temperature sensing potion 58 and the valves 64, 66 are at the same condition as described above at the minimum lifting position, the air introducing passageways 51*a*, 51*b* are not in communication with each other, and the air introduction into the cooling water is not effected. Therefore, even when wax leakage occurs at the high cooling water temperature where cavitation erosion is difficult to occur, the introduction of air into the cooling water is prevented which in turn prevents lowering of the radiator's cooling effect.

Figure 8:
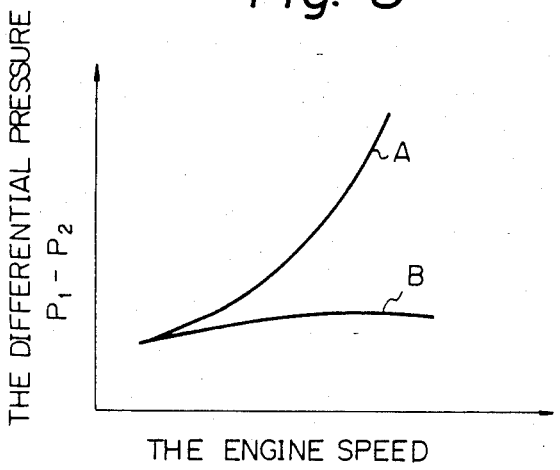
FIG. 8 is a diagram showing variation in pressure difference P1–P2 at inlet and outlet of the air introducing passageway in response to the engine speed.

For air introduction into the cooling water by way of the air introducing passageways 51*a*, 51*b* at the low cooling water temperature range, the outlet end 56 of the air introducing passageway 51*b* is provided adjacent the bypass inlet 35*c* of the water pump 34 and extending from the inner wall of the water pump housing 35 for the distance D, so that the cooling water flow obtains the low pressure P2 adjacent the outlet end 56 lowering of the pressure caused by a greater flow of the cooling water and the pump sucking force. Thus, as shown in FIG. 8A, the differential pressure P1–P2 at the air introducing passageway inlet and outlet becomes greater, which allows easy air mixture into the cooling water which results in increase of an amount of air mixture per unit hour. Consequently, even in the region of low engine speed wherein the cooling water flow speed is slow, the air sucking effect can be sufficiently obtained. When the temperature of the cooling water is raised above the valve closing temperature Tt of the thermostats 32, 33, a part of cooling water is directed to the radiator 22, and the cooling water flow around the sucking port of the water pump 34 becomes uniform. Then the cooling water flow around the bypass inlet 35*c* is lowered so that the pressure P2 around there is rised. Therefore, the differential pressure P1–P2 at the inlet and the outlet of the air introducing passage 42 shows a smaller curve B than a curve A of the low cooling water temperature as is shown in FIG. 8, and even if the control valve 53 is kept open at the high cooling water temperature by some trouble, an amount of air to be introduced into the cooling water is extremely small, so that lowering of the cooling effect can be prevented. However, this reduction of an amount of air to be mixed at the high cooling water temperature by the differential pressure P1–P2 is preferably be undersood as a auxiliary means to help the function of the control valve 53, in terms of precision of the system.

Since the air introducing passageway 51*b* is opened adjacent the sucking port of the water pump 34, air bubbles produced by air mixing are made microscopically small by agitation of the rotation of the impeller of the water pump. Thus, the cooling system has no portion where the air is accumulated, and the flow of air bubbles is uniform to effectively display a buffer effect against the water pressure fluctuations.

The outlet end 56 of the air introducing passageway 51*b* may be opened at some other position, such as, in the bypass 27 or in the main sucking port 35*a* of the water pump. But it is better to have it opened at the bypass sucking port 35*c* in respect of introducing a great amount of air into the cooling water only at the low cooling water temperature.

Figure 7:
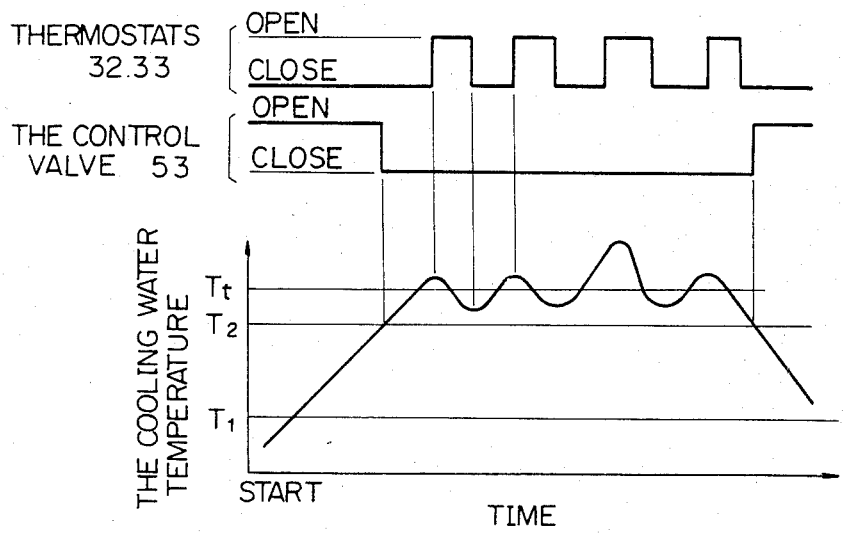
FIG. 7 is a diagram showing control of cooling water temperature by thermostats and closing and opening position of the air flow control valve shown in FIG. 1.

In the present example, the valve closing temperature T2 of the control valve 53 is set at lower than the valve closing temperature Tt of thermostats 32, 33, and this prevents, as shown in FIG. 7, opening and closing of the valve in response to repeated open and close of the thermostats 32, 33 during the engine driving, so that the number of opening and closing operations of the control valve 53 is considerably reduced. This gives a longer life to the control valve 53 and possibility of engaging foreign materials by the control 53 is lowered so as to further improve reliability of air mixture control.

An amount of the air to be introduced from the air storing space 46 into the cooling water by way of the air introducing passageway 51*a* is regulated by the height H between the water pouring inlet 71 of the water tank 41 and the inlet end 52 of the air introducing passageway 51*a*.

In other words, the amount of water poured into the water tank 41 through the water pouring inlet 71 is such as to have the level of the cooling water at the inner upper end of the water pouring inlet 71. Air cannot be introduced any further, when the air in the air storing space 46 of the water tank 41 before the start of engine driving is replaced by the cooling water as its level is raised to the height of the inlet end 52 of the air introducing passageway 51*a*. Thus, the amount of air to be introduced into the cooling water corresponds with the amount of air presents in the height H of the water tank 41.

Consequently, if the dimension of H is selected to an appropriate value for preventing cavitation, for example, to have an amount of air to be mixed against an amount of cooling water as 1–15 volume % or preferably 4–8 volume %, it will effectively prevent cavitation and improve reliability of the engine as well as to maintain the cooling effect of the radiator and the performance of the car heater.

As the temperature of the cooling water is raised the cooling water expands. Because of this, the height of the opening may be determined in such manner that when the cooling water reaches the temperature where cavitation is not likely to occur the cooling water level L after expansion of the cooling water should be positioned above the opening portion of the air introducing passageway 51*a*. Then, air cannot be sucked from the opening portion in the temperature range where cavitation also not occur, so as to provide safety measures for the control valve 53 when it is not in use.

Instead of arranging the waterpouring inlet 71 extending into the water tank 41A, it may be formed, as shown in dots-and line 41A in FIG. 1, by tapering the side corner wall of the water tank 41 so as to have the water pouring inlet opened at the inclined surface directly.

Other preferable examples of the air metering out means provided in the water tank are shown in FIGS. 9–13.

Figure 9:
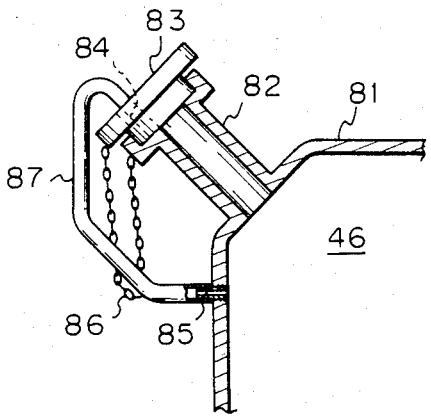
FIG. 9 is a schematic sectional view showing, in an enlarged scale, the principle part in another embodiment of the air metering means associated with the water tank of the invention.
Figure 10:
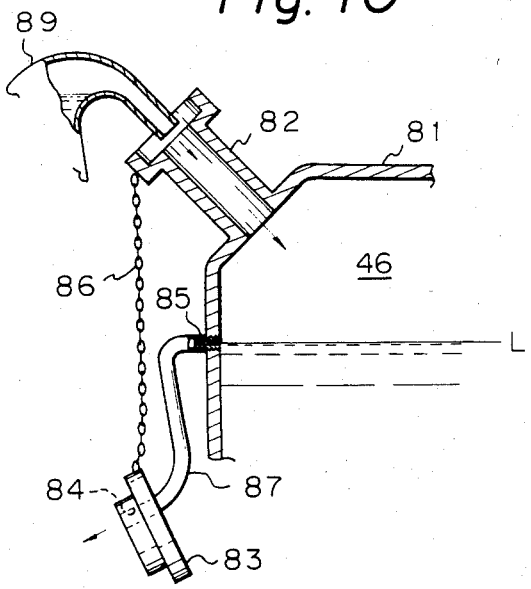
FIG. 10 is an explanate diagram of water pouring into the water tank shown in FIG. 9.

The example of FIGS. 9 and 10 is to regulate the maximum level of the cooling water which is supplied into a water tank 81, before the engine start, as in the case of the example of FIG. 1. Namely, generally a filler cap 83 is placed on the outer end of a water pouring inlet 82 of the water tank 81 to seal the water pouring inlet 82. Filler cap 83 is provided with an outlet port 84 which passes through the cap in axial direction. Also, an exhaust port 85 is provided at a predetermined height to the side wall of the water tank 81. The outlet port 84 and the exhaust port 85 are communicated by a flexible tube 87, such as vinyl tube. The filler cap 83 is suspended by a chain along the outer wall of the water pouring inlet 82 in such manner that it is located at a position lower than the position of the exhaust port 85 when the cap 83 comes off from the water pouring inlet 82, as shown in FIG. 10.

With this arrangement, when a filler cap 83 is removed from the water pouring inlet 82 before the engine start, and when the water is introduced into the water tank from a tank 89, the cooling water is discharged outside from the outlet port 84 by way of the tube 87, and the cooling water level L is not increased above the level of the exhaust port 85. To achieve this, the volume in the water tank above the exhaust port 85, specifically the volume in the water tank between the exhaust port 85 and the inlet of the air introducing passageway, should be set as corresponding to an amount of air to be mixed into the cooling water required for prevention of cavitation.

Figure 11:
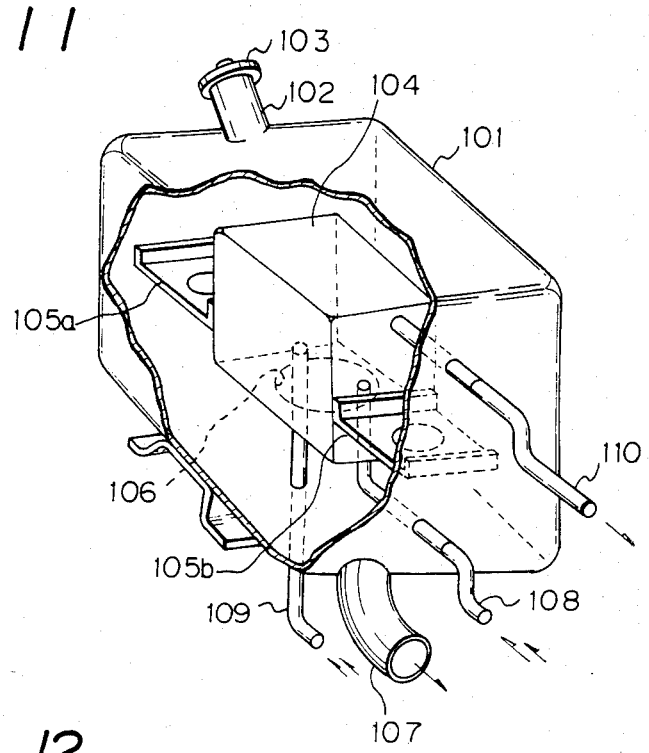
FIG. 11 is a partially broken perspective view showing a still another embodiment of the water metering means associated with the water tank.

The example of FIG. 11 illustrates the water tank having another air metering out means. A water tank 101 has water pouring inlet 102 and a filler cap 103, and an auxiliary tank 104 as the air storing space is supported by brackets 105*a*, 105*b* in the water tank 101. The auxiliary tank 104 is communicated with the water tank 101 through an opening 106 provided at the lower portion of the tank. An outlet passageway 107 which communicates with the water pump sucking side is opened in the bottom wall of the water tank 101, an inlet passageway 109 communicating with the upper tank of the radiator and an inlet passageway 109 communicating with the upperstream of the thermostat housing are both opened into the auxiliary tank 104, and an air introducing passageway 110 is opened into the upper part of the auxiliary tank 104.

Thus, when the cooling water is introduced through the water pouring inlet 102, the cooling water level in the auxiliary tank 104 is near the opening 106, however much the cooling water level in the water tank 101 is increased by the introduction of the cooling water. Therefore, an amount of air to be introduced through an air introducing passageway 110 corresponds with an amount of air in the auxiliary tank 104 which has been pushed by the cooling water until the cooling water level in the auxiliary tank 104 covers an air taking port of the air introducing passageway 110, namely, corresponds with an air volume in the auxiliary tank 104 between the lower opening 106 and the air taking port of the air introducing passageway 110. This has no relation to the temperature of the cooling water at the time of introduction. When the cooling water expands by increase of the temperature by driving of the engine after introduction of the cooling water, the cooling water level in the water tank 101 is raised. At this time, the air layer at the upper portion of the water tank 101 also expands, but the air pressure is relieved outside by the safety valve function of the filler cap 103. As such, the cooling water level in the water tank 101 changes and an amount of air in the upper space of the water tank 101 is reduced, but the cooling water level in the auxiliary tank 104 is kept at substantially the same level, since the air storing space has no function to relieve the air the atmosphere.

Consequently, even if the cooling water expands in response to the difference in temperatures of the cooling water between the time of pouring and after starting the engine, the amount of air in the auxiliary tank 104 will not change, and there will be no increase or reduction if the amount of air mixture. Any excess air in the auxiliary tank 104 is floated upwardly to the upper space in the water tank 101 by overflowing from the opening 106.

Figure 12:
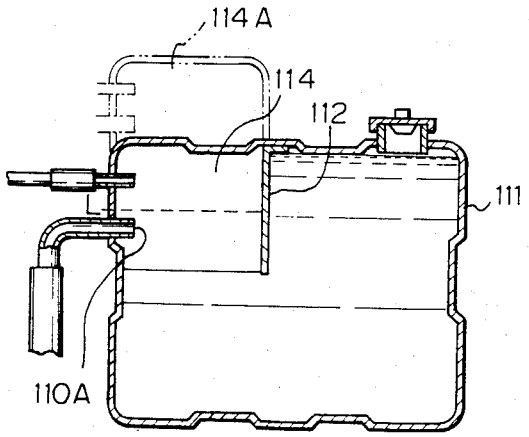
FIG. 12 is a vertical section showing further another embodiment of the air metering means associated with the water tank.

As shown in FIG. 12, an auxiliary tank 114 may be constructed by suspending a partition 112 from the upper wall of a water tank 111. In the example of FIG. 12, an air introducing passageway 110A also serves as the outlet passage for the cooling water. In this case, the air introducing passageway 110A allows the air and/or the cooling water to be sucked around the sucking port of the water pump in response to the cooling water level L. As shown in dots-and line in FIG. 12, auxiliary tank 114A may be formed by bending a part of the upper wall of the water tank 111 upwardly.

Air storing means is not limited to the above-described examples, but many other modifications can be easily considered, and the present invention includes such modifications.

In the present invention, one of the features is to detect the engine condition where cavitation erosion is likely to occur on the water jacket wall or such cavitation erosion is already produced, and to control the air flow control valves in response to such detected engine condition. Modifications of this feature will be explained below.

Figure 13:
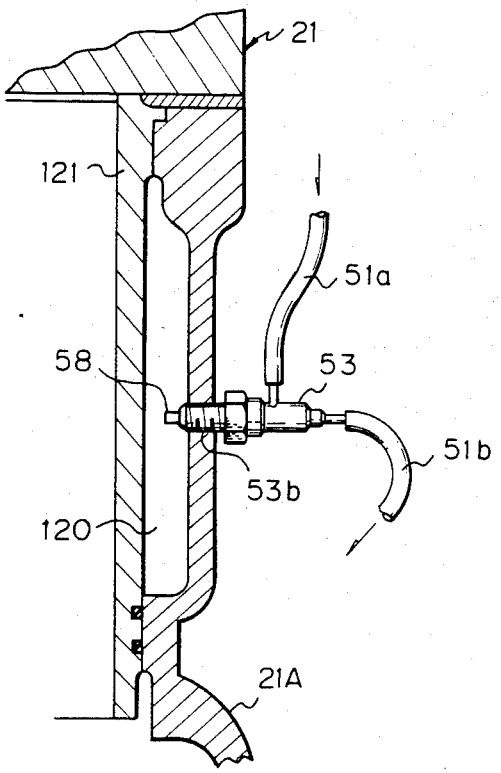
FIG. 13 is a vertical section of the essential part of the engine, showing a variation of the metering valve shown in FIG. 1 which is here mounted on the water jacket wall of the engine.

The cooling water temperature showing one of the engine condition may be detected in the manner as shown in FIG. 13 where the temperature sensing portion 58 of the controls valve 53 as is shown in FIG. 1 is placed in a water jacket 120 of the cylinder block 21A of the engine. In this case, it is preferable that the valve 53 has a valve closing temperature, which is slightly higher than 74° C. of the cooling water temperature in the thermostat housing for closing the valve shown in FIG. 1, that is for example 80° C. of the cooling water temperature in the water jacket 120, taking into consideration difference of the cooling water temperature between in the water jacket 120 and in the thermostat housing.

Figure 14:
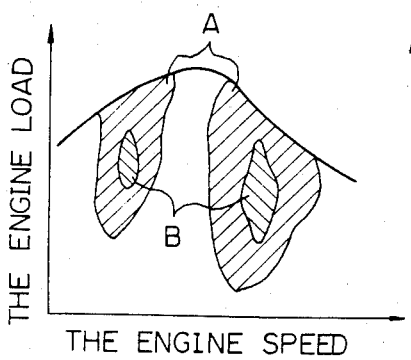
FIG. 14 is a diagram showing the relationship established among the engine speed, the load and the amount of produced cavitation erosion.
Figure 15:
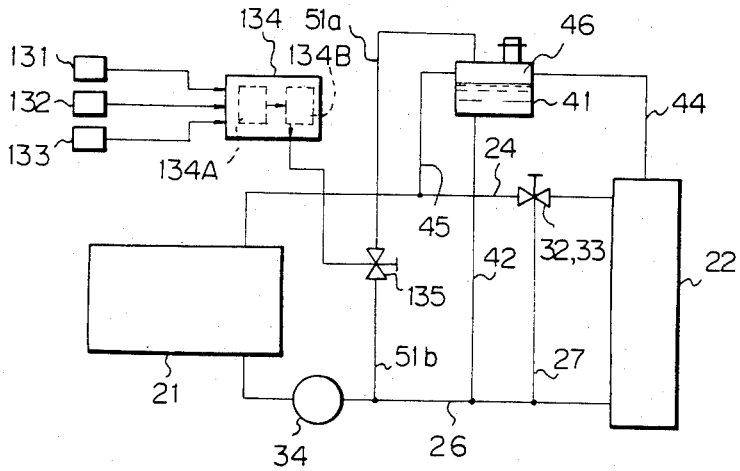
FIG. 15 is a schematic view showing another embodiment of the cavitation prevention system according to the present invention.

The engine condition which tends to produce cavitation erosion is, as shown in FIG. 14, having different cavitation distribution according to the engine rotating speed and the load. In the drawing, A denotes the area where occurrence of cavitation erosion is recognized, and B denotes the area where cavitation erosion is notable. Then, as shown in FIG. 15, the following means may be provided. For example, a known engine rotation sensor 131 for detecting the rotating speed of the engine and a load sensor 132 for detecting the known engine load. Then the engine driving condition can be detected by these sensors. A control unit 134, as a microcomputer valve control means, comprising an input/output interface, a central processing unit and storage means stores the engine rotating speed and the load data of the areas A and B where, as shown in FIG. 14, cavitation erosion is likely to occur which has been determined beforehand by experiments. The stored value and the detected engine condition are compared and the engine condition which is in the state of producing cavitation erosion is judged by a judging means 134A, whereupon the signal is output from a valve driving means 134B to an electromagnetic valve 135. The electromagnetic valve 135 is interposed between the air introducing passageways 51*a*, 51*b* in place of the control valve of FIG. 1, and the electromagnetic valve 135 is opened by a conductive excitation signal from the control unit 134 to allow the air to be sucked into the air sucking side of the water pump 34 from the air storing space of the water tank 41, thereby to prevent occurrence of cavitation. It is also possible to provide an engine cooling water temperature sensor 133 to input its signal into the control unit 134, and if the judging means 134A judges that the detected signal is in the predetermined temperature range which allows easily occurence of cavitation, the electromagnetic valve is opened by means of a valve driving means 134B. With this arrangement the air can be introduced into only the cooling water in the low cooling water temperature range, as in the case of the example of FIG. 1. With the above-described means, prevention of introduction of air into the cooling water in the area where cavitation is difficult to occur is ensured, and the cooling effect can be improved. As the engine driving condition, it is possible to select other condition, such as, fuel injection timing, as representing the engine condition, than the above-described engine rotating speed and the load.

The engine condition for allowing eacy occurrence of cavitation can be known by a ratio of an amount of air to be mixed to an amount of the cooling water, namely, the air mixture ratio.

Figure 16:
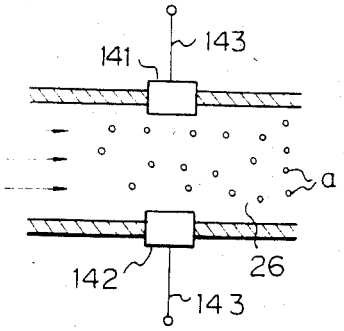
FIG. 16 is a schematic vertical section illustrating the air mixture ratio detecting means as an embodiment of the engine condition detecting means according to the present invention.
Figure 17:
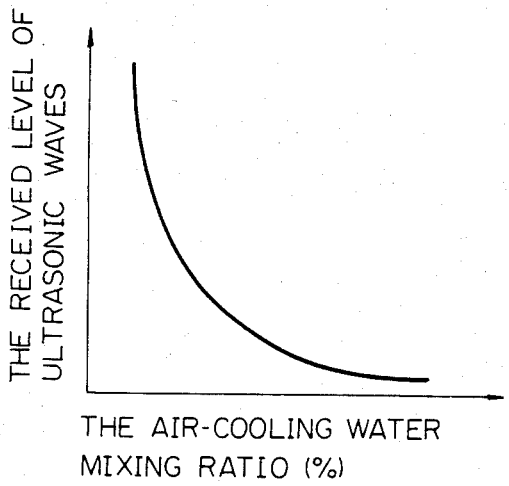
FIG. 17 is a diagram the relationship between the air mixture ratio and the received level of ultrasonic waves.

The air mixture ratio varies depending on an amount of air with respect to an amount of cooling water and on decrease of the amount of cooling water by evaporation or leakage. Thus, a detector for detecting the air mixture ratio is arranged in the cooling water circulating passageway, for example, in the upper passage. As shown in FIG. 16, an ultrasonic oscillator 141 and a receiver 142 are provided on the inner wall of the cooling water passageway, and they are disposed to face at a right angle in the following direction of the cooling water. Ultrasonic waves generated by the oscillator 141 are received by the receiver 142 through the cooling water. Receiving level at the receiver is lowered as the mixture ratio of air bubbles in the cooling water increases. This receiving level in the receiver 142 is input into the microcomputer by way of a lead wire 143 to be compared with a predetermined level by the judging means 134A so as to know the low air mixture ratio which allows easy occurrence of cavitation, and provide an output to open the electromagnetic valve 135 by the valve driving means 134B, or know the lowering of the cooling effect of the cooling water by the air mixture ratio which is higher than the predetermined value and provide an output to close the electromagnetic valve 135. In this manner the air mixture ratio is kept at the predetermined value and the cooling water condition which has a better cooling performance without producing cavitation can be formed. In this case it is preferable to also make controlling of opening and closing of the electromagnetic valve in response to the cooling water temperature.

The engine condition which allows easy occurrence of cavitation can be known by detecting substantial circumstances under which cavitation occurs. During the engine driving, the water pressure fluctuations occur in the water jacket by vibrations of the cylinder liner or the cylinder block. When cavitation occurs, an ultrasonic wave is produced. This ultrasonic wave has a broad-band frequency response characteristic, and, therefore, by setting a resonance frequency for the ultrasonic oscillator in the broad-band, the ultrasonic oscillator is oscillated by generation of the ultrasonic wave, and through such oscillation the occurrence of cavitation can be detected. The ultrasonic oscillator may be arranged in place of the control valve 53 of FIG. 13. When the ultrasonic oscillator makes oscillation, the control unit 134 of FIG. 15 outputs the signal based on the oscillation, thereby to open the electromagnetic valve 135.

Figure 18:
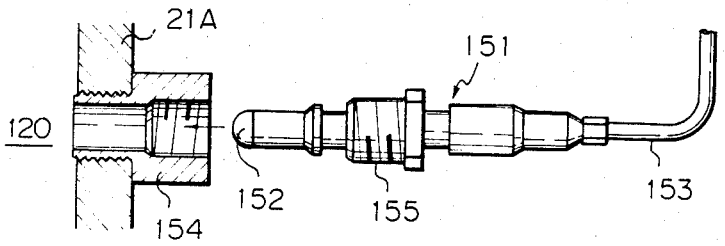
FIG. 18 is a vertical section showing the ultrasonic oscillator as another embodiment of the engine condition detecting means according to the present invention.

An ultrasonic oscillator 151 has, as shown in FIG. 18, at its forward end a pickup 152 for sensing the ultrasonic wave and which is made by such a material as a piezo rubber, and this pickup portion 152 is connected to the control unit 134 by way of a coaxial cable 153. The pickup portion 152 is then inserted into a hollow mounting bush 154 and clamped therein with a tightening nut. The mounting bush 154 having the ultrasonic oscillator 151 mounted thereon is screwed and secured to the side wall surface of the cylinder block of the water jacket 120 formed by the cylinder block 21A and the cylinder liner 121.

Figure 19:
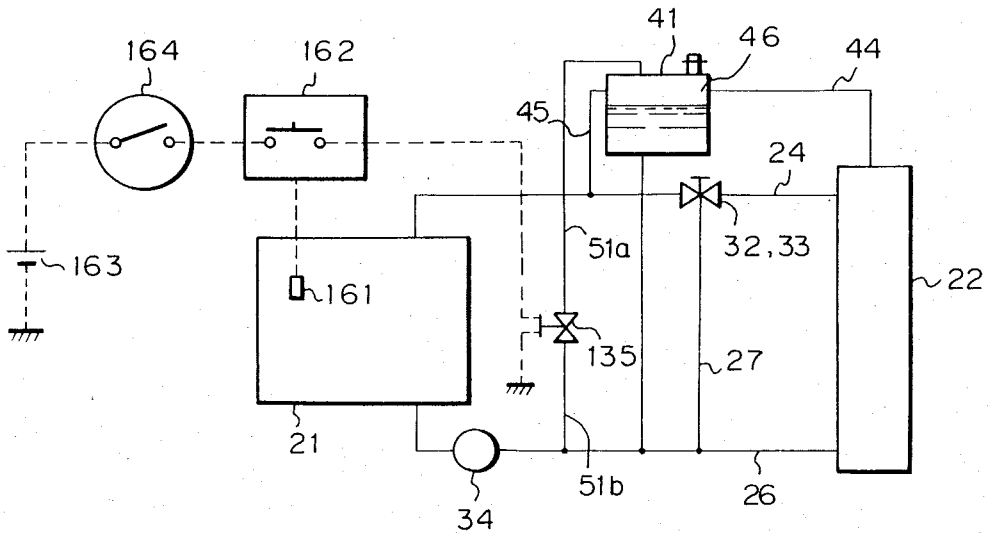
FIG. 19 is a schematic view showing still another embodiment of the cavitation prevention system according to the present invention.

It has been explained by referring to FIG. 6 that the engine condition which allows easy occurrence of cavitation is in the area where the engine cooling water temperature is below a predetermined value, in which occurrence of cavitation is notable. This area of the low engine temperature is, roughly speaking, in a certain period after starting the engine. Thus, detection of the engine condition which allows easy occurrence of cavitation can be made by detecting the starting of the engine as shown in FIG. 19. Namely, an oil pressure switch 161 adapted to be in OFF state by rising of an engine oil pressure above a predetermined value is mounted to the engine 21, and a timer 162 adapted to put the oil pressure switch 161 in ON state for a predetermined period after the oil pressure switch 161 has been put in OFF state is provided. Then form a valve control means for the electromagnetic valve 135 comprising a battery 163, an engine, an engine key switch 164, the timer 162, the electromagnetic valve 135 and a series circuit of grounding.

For starting the engine, put the key switch 164 ON, then the timer 162 is rendered conductive by the supply of current from the battery 164, so that the timer becomes operable. When the engine is actually started and the engine oil pressure rises to turn off the oil pressure switch 161, a contact of the timer 162 is closed by this OFF signal and it is now in ON state. Then, the electromagnetic valve 135 mounted in the air introducing passageways 51*a*, 51*b* are rendered conductive thereby to open the communication between the air introducing passageways 51*a*, 51*b*. Consequently, the air in the air storing space 46 of the water tank 41 is introduced into the cooling water in the form of air bubbles, by way of the air introducing passageways 51*a*, 51*b*. This air mixing is continued during the period of continued ON state of the timer 162.

After the lapse of the time set by the timer 162, the timer 162 is turned off, thereby the electromagnetic valve 135 is rendered nonconductive to close the valve so that the air introducing passageways 51*a*, 51*b* are closed and air mixture into the cooling water is stopped. However, at this time, the temperature of the cooling water is sufficiently high so that it is not likely to have occurrence of cavitation.

What is claimed is:

1. Cavitation prevention system in water-cooled internal combustion engine particularly for suppression of cavitation erosion occurring on a water jacket wall, said system comprising;

a cooling water circulating passageway for circulating said cooling water between the water jacket of the engine and a radiator to transfer a heat generated in the engine to the radiator by means of said cooling water and thereby to radiate the heat therein;

a water pump mounted in the cooling water circulating passageway to supply the cooling water forcibly under a pressure;

means for storing air having an inlet passageway and an outlet passageway both in communication with the cooling water circulating passageway, said air storing means being disposed above the cooling water circulating passageway and having at its upper portion a space for storing air to be introduced into the cooling water in the cooling water circulating passageway;

air metering means for regulating an amount of air to be supplied to the cooling water circulating passageway and which is provided in the air storing means;

an air introducing passageway communicating the air storing space of the air storing means with the air sucking side of the water pump to lead the air from the air storing means into the cooling water to be mixed therewith by means of a suction pressure of the pump;

air flow control valve means mounted in the air introducing passageway;

means for detecting the engine condition which is likely to produce cavitation erosion on the water jacket wall; and valve control means adapted to operate the air flow control valve means with an output of the detecting means to provide a high air flow at the engine condition which is likely to produce cavitation erosion.

2. Cavitation prevention system according to claim 1, wherein said air storing means comprises a water tank; wherein said inlet passageway comprises a passageway fluid connecting said water tank with a portion of said cooling water circulating passageway which is exposed to a delivery pressure of said water pump; and wherein said outlet passageway comprises a passageway fluid connecting the bottom portion of said water tank and a portion of said cooling water circulating passageway which is exposed to a suction pressure of said water pump.

3. Cavitation prevention system according to claim 2, wherein said water tank has a pouring port adapted to pour the cooling water into said cooling water circulating passageway; and wherein said air metering means is so arranged that an inner end of said pouring port is opened in said water tank, an inlet end of said air introducing passageway into said water tank is opened above said inner end of the pouring port, and a volume capacity of the water tank defined between the inner end of said pouring port and the inlet end of said air introducing passageway corresponds to an amount of air to be mixed into the cooling water to achieve the cavitation preventive effect.

4. Cavitation prevention system according to claim 2, wherein said air metering means is so arranged that, when the cooling water has been heated to a temperature at which no cavitation easily occur and, in consequence, a volume of said cooling water has been expanded, the inlet end of said air introducing passageway lies at a position lower than the cooling water level which has been raised as a result of such volume expansion.

5. Cavitation prevention system according to claim 2, wherein said air metering means includes a hermetically closed auxiliary tank having a lower port in fluid communication with the cooling water within the water tank, said outlet of said inlet passageway and said inlet end of said air introducing passageway being in communication with said auxiliary tank, and said inlet end of said air introducing passageway is set to a height such that a volume capacity of said auxiliary tank defined between said inlet end and the lower port of said auxiliary tank corresponds to an amount of air to be mixed into the cooling water to achieve the cavitation preventive effect.

6. Cavitation prevention system according to claim 2, wherein said air metering means comprises a flexible tube having at one end a cooling water outlet port opening into said water tank at a side wall thereof, an outlet port to which another end of said tube is connected, and a filler cap adapted to shut off a communication of said outlet port with the exterior of said water tank, and said air metering means is so arranged that a volume capacity of said water tank defined between the outlet port of said tube and the inlet of said air introducing passageway corresponds to an amount of air to be mixed into the cooling water to achieve the cavitation preventive effect.

7. Cavitation prevention system according to claim 2, wherein said cooling water circulating passageway comprises a bypass passageway for leading the cooling water from the water jacket to said water pump without through said radiator; and a temperature-sensitive valve being interposed within the inlet portion of said bypass passageway to open said bypass passageway in response to a temperature of the cooling water when said temperature is lower than a predetermined value; wherein said air introducing passageway is connected between said air storing space of the water tank and the suction side of said water pump where said bypass passage is communicated so as to direct the air stored within said water tank into the cooling water under a suction pressure of the water pump; and wherein said means for detecting the engine condition is a temperature sensor adapted to detect an actual temperature of cooling water which is sensed by said temperature-sensitive valve means and said valve control means is adapted so as to open said air flow control valve means when said temperature of cooling water is lower than a predetermined value at which said temperature-sensitive valve means is closed.

8. Cavitation prevention system according to claim 1, wherein said air introducing passageway has its outlet end projecting from an inner wall of a water pump housing in a region of the suction port of the water pump.

9. Cavitation prevention system according to claim 1, wherein said air flow control valve means comprises valve means adapted to adjust an opening area of said air introducing passageway as said valve means displaces; wherein said engine condition detecting means comprises wax material which is subjected to the temperature of the cooling water flowing form said engine to said radiator and has its volume changed in response to a temperature variation in said cooling water; and wherein said valve control means comprises a casing which holds said wax material so that the volume change may occur only in one direction and means adapted to transmit said volume change of wax material to said valve means.

10. Cavitation prevention system according to claim 1, wherein said air flow control valve means comprises an electromagnetic valve inserted in said air introducing passageway; and said valve control means comprises electric switch means adapted to control on-off of an electric signal applied to said electromagnetic valve according to a detection value provided from said engine condition detecting means.

11. Cavitation prevention system according to claim 1, wherein said air flow control valve means comprises an electromagnetic valve; and wherein said valve control means comprises means to determine a condition in which a cavitation erosion has already occurred or is likely to occur from a comparison of an engine state detection signal provided from said engine condition detecting means with a reference value and means to drive said electromagnetic valve at the condition thus determined by said former means to be the condition in which a cavitation erosion has already occurred or is likely to occur.

12. Cavitation prevention system according to claim 11, wherein said engine condition detecting means comprises a temperature sensor adapted to detect an actual temperature of cooling water in the engine.

13. Cavitation prevention system according to claim 11, wherein said engine condition detecting means comprises means adapted to detect engine operation factors inclusive of a load and a speed of the engine.

14. Cavitation prevention system according to claim 11, wherein said engine condition detecting means comprises means adapted to detect an air mixture ratio in the cooling water.

15. Cavitation prevention system according to claim 11, wherein said engine condition detecting means comprises a supersonic oscillator mounted on the water jacket wall of said engine and adapted to detect a supersonic oscillation generated due to an occurrence of a cavitation.

16. Cavitation prevention system according to claim 1, wherein said air flow control valve means comprises an electromagnetic valve inserted in said air introducing passageway; wherein said engine condition detecting means comprises means adapted to detect start of the engine; and wherein said valve control means comprises delay means adapted to transmit an engine start signal provided from said start detecting means to said electromagnetic valve with a predetermined time delay to close said valve.

* * * * *